US009316427B2

(12) United States Patent
Lopes et al.

(10) Patent No.: US 9,316,427 B2
(45) Date of Patent: Apr. 19, 2016

(54) DIRECT CONTACT ICEMAKER WITH CHAMBERED AIR COOLING SYSTEM

(75) Inventors: Luiz Antonio D. Lopes, Peachtree City, GA (US); Lorraine J. Westlake, Eau Claire, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 805 days.

(21) Appl. No.: 13/038,451

(22) Filed: Mar. 2, 2011

(65) Prior Publication Data

US 2012/0222432 A1 Sep. 6, 2012

(51) Int. Cl.

| | |
|---|---|
| ***F25D 23/04*** | (2006.01) |
| ***F25C 5/18*** | (2006.01) |
| ***F25D 17/06*** | (2006.01) |
| ***F25C 5/00*** | (2006.01) |
| *F25D 11/02* | (2006.01) |

(52) U.S. Cl.

CPC ..... *F25C 5/182* (2013.01); *F25C 5/005* (2013.01); *F25D 17/065* (2013.01); *F25C 2400/10* (2013.01); *F25D 11/022* (2013.01); *F25D 2317/061* (2013.01); *F25D 2317/063* (2013.01)

(58) Field of Classification Search

CPC ..... F25D 2317/063; F25D 2317/061; F25D 17/065; F25D 11/022; F25D 2317/067; F25C 5/182; F25C 5/185; F25C 5/005

USPC ..... 62/66, 74, 344, 407, 340

See application file for complete search history.

(56) References Cited

U.S. PATENT DOCUMENTS 4,165,716 A * 8/1979 Thomas et al. ..... 122/1 A
5,345,997 A * 9/1994 Drossler et al. ..... 165/47
6,003,594 A * 12/1999 Cameron et al. ..... 165/297
6,093,312 A * 7/2000 Boulter ..... B67D 1/0009 210/109
7,752,859 B2 7/2010 Lee et al.
8,099,968 B2 * 1/2012 Watson ..... F25C 5/08 62/344
8,171,744 B2 * 5/2012 Watson ..... F25B 7/00 62/340
2008/0155993 A1 7/2008 Kuehl
2009/0288428 A1 * 11/2009 Kopf ..... F25C 5/187 62/66
2010/0115985 A1 5/2010 Mitchell et al.
2010/0138073 A1 6/2010 Tarr
2010/0186429 A1 * 7/2010 Watson ..... F25C 5/08 62/66
2010/0218519 A1 9/2010 Hall et al.
2010/0218542 A1 * 9/2010 McCollough ..... F25C 5/005 62/345
2010/0242526 A1 9/2010 Junge et al.
2010/0326093 A1 * 12/2010 Watson ..... F25B 7/00 62/66
2011/0252816 A1 * 10/2011 Kulkarni ..... F25B 1/00 62/81

FOREIGN PATENT DOCUMENTS

EP 1939554 * 7/2008

* cited by examiner

*Primary Examiner* — Frantz Jules
*Assistant Examiner* — Martha Tadesse

(57) ABSTRACT

A refrigerator includes a direct contact ice making system in conjunction with a circulating liquid coolant. The ice making system includes a coolant loop and an air flow chamber on a portion of the loop. The air flow chamber includes channels formed by offset protrusions, which direct air back and forth over the portion of the cooling loop to cool ambient air within the ice making system. The cooled air is then directed by a fan and supply duct to an ice storage container to prevent ice cubes in the container from melting. Once the air has warmed in the container, it is directed by a return duct to the beginning of the air flow chamber to begin the process over once again, thus creating a recirculation of air within a refrigerator system to cool an ice storage container.

19 Claims, 7 Drawing Sheets

DIRECT CONTACT ICEMAKER WITH CHAMBERED AIR COOLING SYSTEM

FIELD OF THE INVENTION

The invention relates generally to the field of refrigerators. More specifically, but not exclusively, the present invention provides an apparatus and method for producing and directing cooled air to an ice storage compartment to prevent the formed ice in the compartment from melting before being used.

BACKGROUND OF THE INVENTION

Many refrigerators contain ice making compartments located within either a freezer or refrigerator compartment. Typically, the ice making compartments include at least an ice mold, a water supply, and an ice storage compartment or container. Water is added to the ice mold from the water supply. A cold air source provides cold air that is passed over the water and the ice mold to freeze the water, forming ice cubes. Typically, a heat exchanger cools the air. A coolant may be used in the heat exchanger. After warming, the coolant must pass through a condenser and evaporator to re-cool to be able to be used to cool down new air in the ice making compartment.

The frozen cubes are then dislodged from the molds and transferred into the storage compartment. Because of the proximity of the storage compartment to the ice mold, the cold air that is used to freeze the water in the mold is also used to maintain the temperature of the storage compartment to below freezing. The cold air simply passes over the ice mold and continues through an opening in the storage compartment to the container of the frozen, dislodged ice. Using cooled air to form the ice and to keep the frozen ice from melting consumes a rather large amount of energy, which is costly to the refrigerator owner. The condenser and evaporator require energy to re-cool the coolant used to cool the ice making compartment, and a high volume of air must be cooled to be able to both freeze the ice and keep the temperature of the storage compartment below freezing.

To reduce the amount of electricity a refrigerator uses, other methods of freezing ice have been utilized. One such method involves direct contact cooling to form ice. The ice mold is placed in direct contact with a portion of the coolant loop so that the coolant moving through the loop absorbs the heat from the water in the mold to form ice cubes. As the coolant is able to absorb more heat than cooled air passing over the ice molds, less energy is needed. Therefore the cost of forming ice in the mold is reduced.

However, because the icemaker does not include the use of cooled air to form ice, no cooled air is available to maintain the temperature of the ice storage compartment below freezing. The formed ice is exposed to above freezing temperatures, which can cause the ice to melt, negating the ice making process. Efforts have been made to include portions of the coolant loop within the ice storage compartment, but this has not been practical when the storage compartment is part of a door of the refrigerator.

Accordingly, there is a need in the art for an apparatus and method of producing and directing cooled air to the ice storage compartment of a refrigerator utilizing a direct contact ice making process. There is also a need in the art for a method of producing cooled air for maintaining the temperature of an ice storage compartment that is cost efficient.

SUMMARY OF THE INVENTION

Therefore, it is a principal object, feature, and/or advantage of the present invention to provide a method and apparatus that overcomes the deficiencies in the art.

It is another object, feature, and/or advantage of the present invention to provide a method and apparatus for providing a direct contact icemaker to form ice in a mold.

It is another object, feature, and/or advantage of the present invention to provide a method and apparatus to cool air in an icemaker compartment and to direct the cooled air to an ice storage compartment.

It is another object, feature, and/or advantage of the present invention to provide a method and apparatus that provides a minimal amount of cold air to an ice bucket in an ice storage compartment to prevent ice cube melt.

Another further object, feature, and/or advantage of the present invention to provide a method and apparatus that re-circulates air in the ice making compartment and ice storage compartment for cooling the ice storage compartment.

Yet another object, feature, and/or advantage of the present invention to provide a method and apparatus that prevent ice from melting using low energy.

These and/or other objects, features, and advantages of the present invention will be apparent to those skilled in the art. The present invention is not to be limited to or by these objects, features and advantages. No single embodiment need provide each and every object, feature, or advantage.

According to one aspect of the present invention, a refrigerator is provided. The refrigerator includes a refrigerator cabinet, a freezer compartment disposed within the refrigerator cabinet, a fresh food compartment disposed within the refrigerator cabinet, at least one door providing access to the fresh food compartment, a direct contact ice maker in the refrigerator cabinet, a cooling loop, an ice storage container adjacent the ice maker, and an airflow chamber. The ice maker is used to make ice cubes and comprises an ice mold and a water supply. The cooling loop includes a portion in contact with the ice mold, and comprising a conduit for fluidly transporting a cooling medium. The airflow chamber is positioned on the cooling loop away from the ice maker, and includes a plurality of offset protrusions creating a channel for air to pass through to cool the air, and a fan assembly attached to the airflow chamber such that the fan assembly directs cooled air to the ice storage container.

According to another aspect of the present invention, a direct contact ice making system is provided. The system comprises a direct contact ice maker, an ice storage compartment, a cooling loop, an airflow chamber, and a fan. The ice maker includes an ice mold and a water supply operably connected to the ice mold. The ice storage compartment is adjacent the ice mold, and includes a removable ice bucket contained within the storage compartment. The cooling loop has a portion in direct contact with the ice mold, and comprises a conduit and a cooling medium transporting through the conduit. The airflow chamber is positioned on a portion of the cooling loop away from the ice mold, and includes a plurality of offset protrusions to create an air channel for cooling ambient air passing through the channel. The fan is operably connected to the airflow chamber.

According to yet another aspect of the present invention, a method of providing continuous cold air circulation for an ice storage compartment in conjunction with a direct contact ice making system is provided. The method includes the step of providing a refrigerator including a direct contact ice making system comprising an ice mold, a cooling loop having a portion in direct contact with the ice mold, an airflow chamber positioned on a portion of the cooling loop away from the ice mold, and a fan operably connected to the airflow chamber, and an ice storage compartment adjacent the ice making system. Ambient air is cooled within the airflow chamber adjacent the portion of the cooling loop. The cooled air is directed with the fan from the chamber to the ice storage compartment. Warmed air within the ice storage compartment is then directed to the airflow chamber, wherein the warm air is re-cooled and redirected to the storage compartment.

DETAILED DESCRIPTION OF THE PREFERRED EMBODIMENTS

Figure 1:
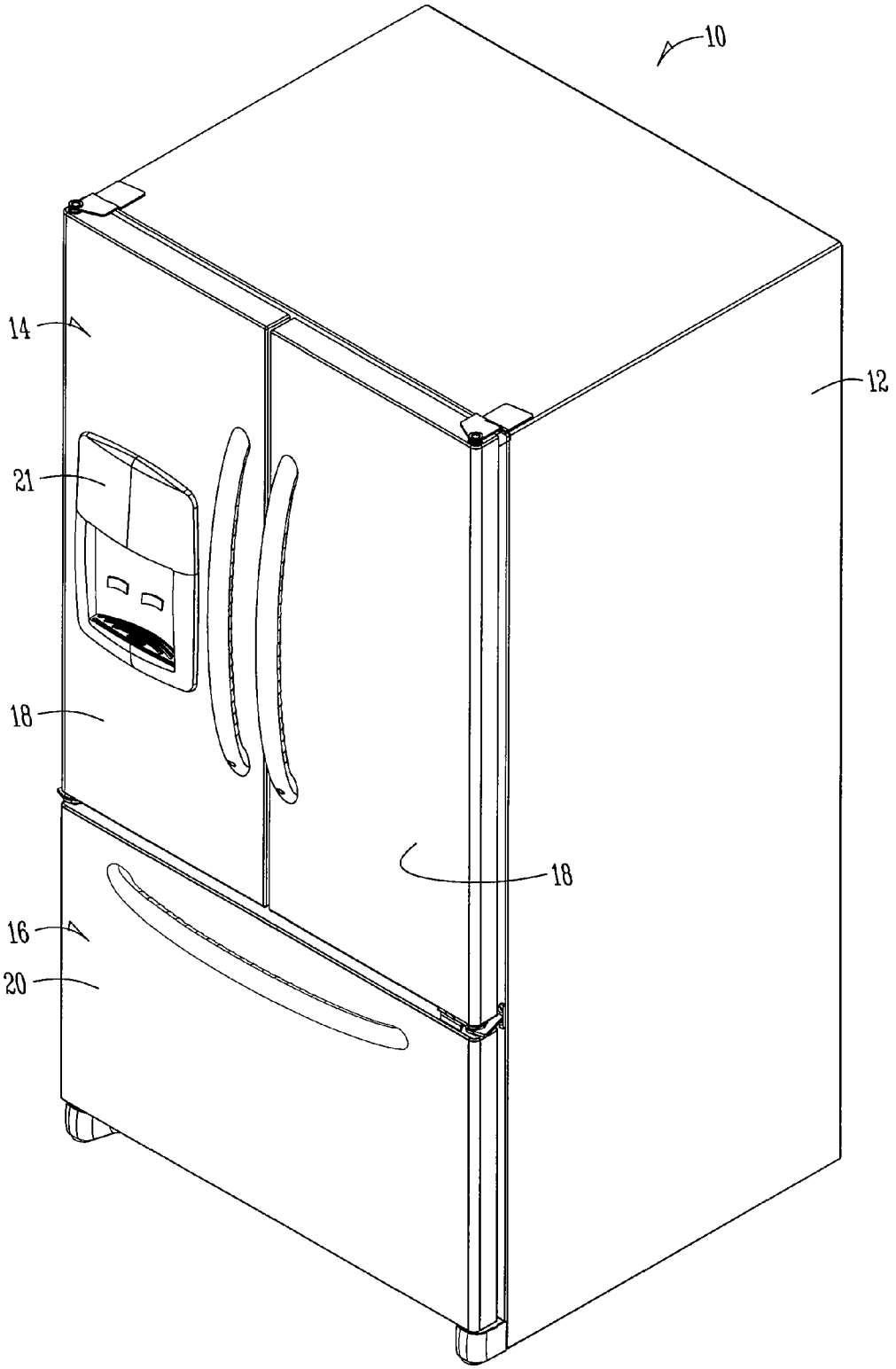
FIG. 1 is a perspective view showing one embodiment of a refrigerator having a direct contact ice making compartment.

FIG. 1 illustrates an embodiment of a refrigerator 10. The refrigerator 10 includes a refrigerator housing or cabinet 12. A fresh food door 18 provides access to a fresh food compartment 14. A freezer door 20 provides access to a freezer compartment 16. The refrigerator 10 of FIG. 1 also shows a second fresh food door 18, but it should be appreciated that only one door is required. The refrigerator 10 is shown in a bottom mount configuration in that the freezer compartment 16 is positioned below the fresh food compartment 14. An ice and water dispenser 21 is positioned on one of the fresh food compartment doors 18. Note that the ice and water dispenser 21 is positioned remotely from the freezer compartment 16. It should be appreciated that other types of refrigerators may be used, and the present invention is not limited to use in the configuration shown in FIG. 1.

Figure 2:
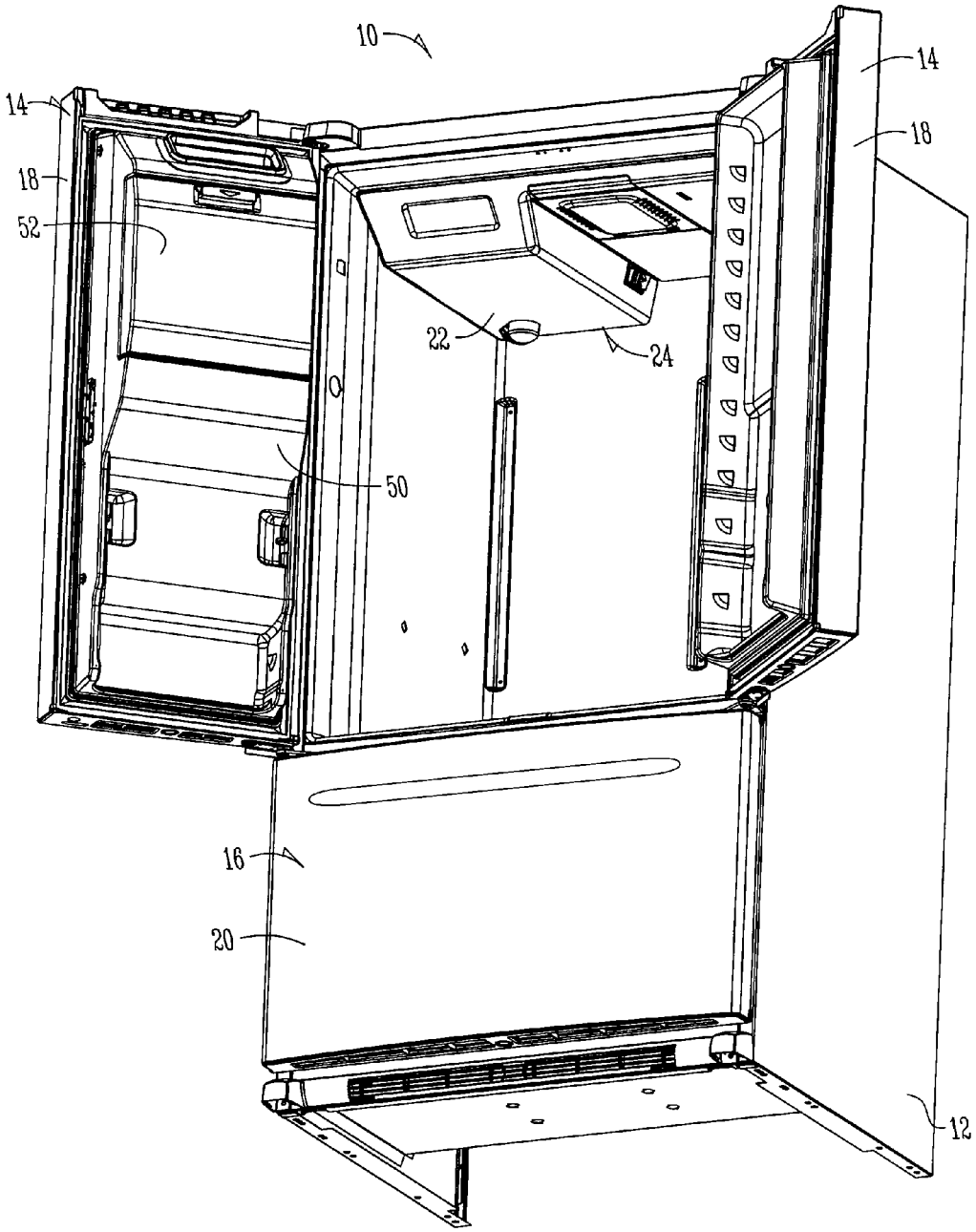
FIG. 2 is a perspective view of the refrigerator of FIG. 1 with doors open and showing the ice making compartment and ice storage compartment.
Figure 3:
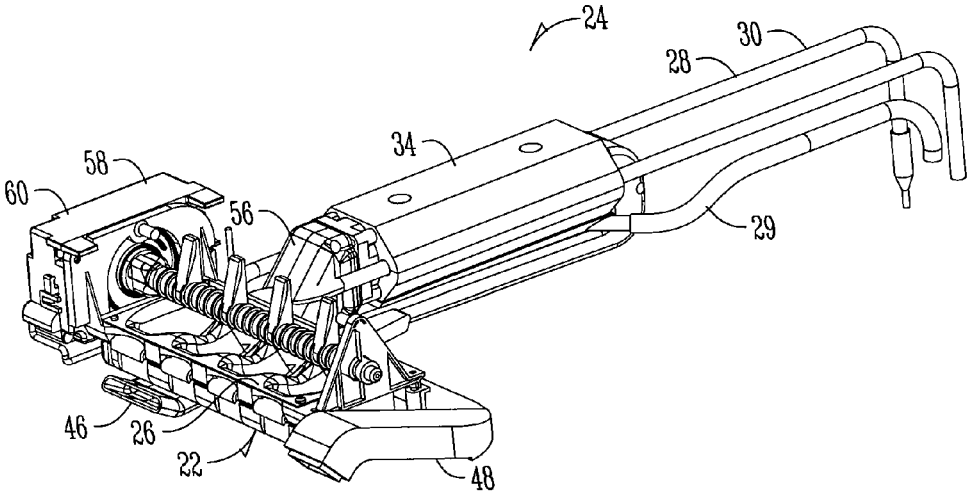
FIG. 3 is a top perspective view of an ice making system of the present invention.
Figure 4:
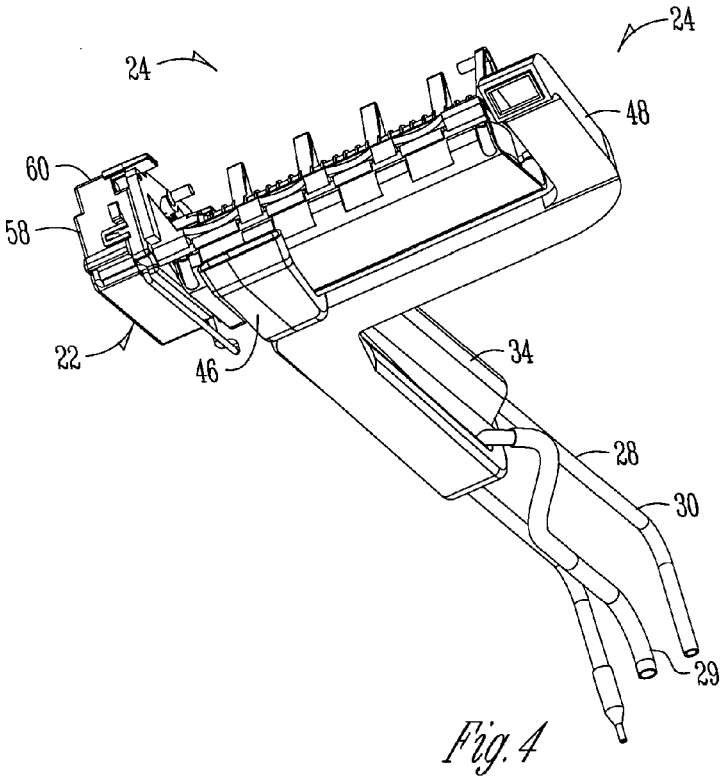
FIG. 4 is a bottom perspective view of the ice making system of FIG. 3.

FIG. 2 illustrates the refrigerator 10 of FIG. 1 with fresh food doors 18 in open positions. An ice making system 24, is shown positioned within the fresh food compartment 14, and adjacent one of the fresh food doors 18. Also shown in FIG. 2 is an ice storage container or compartment 50. In the embodiment shown in FIG. 2, the ice storage compartment 50 includes a removable ice bucket 52 contained within the storage compartment. It should be appreciated that the removable ice bucket does not have to be separate from the ice storage compartment 50, but the bucket makes it easier to remove ice.

Figure 9:
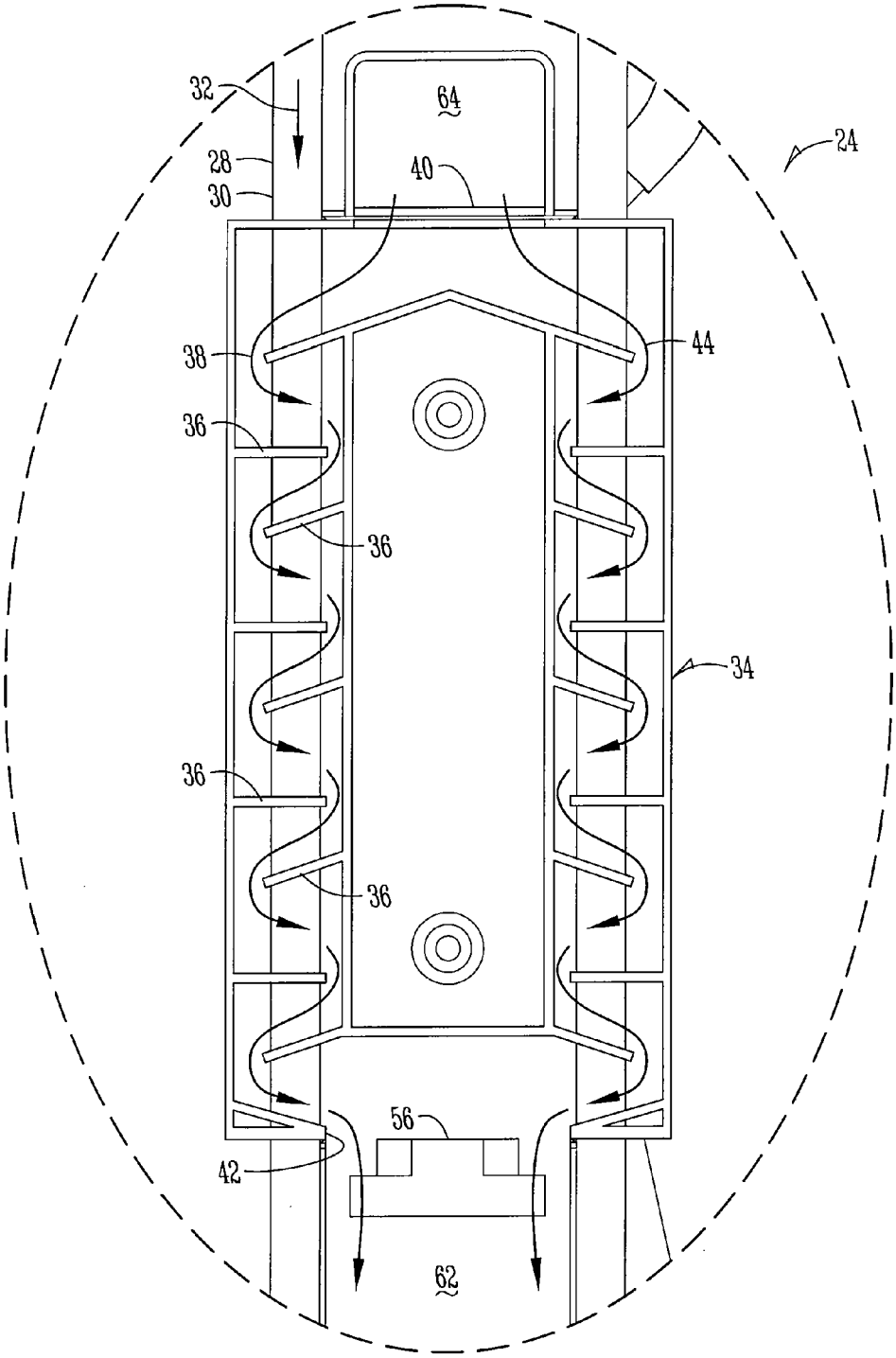
FIG. 9 is an enlarged sectional view of the top of the ice making system according to line 9-9 of FIG. 5.

FIGS. 3-9 show views of an ice making system 24 of the present invention. The ice making system 24 includes a direct contact ice maker 22, comprising an ice mold 26, a cooling loop 28, a water supply 58, and an intelligent control 60. The cooling loop 28 comprises a conduit 30, through which a cooling medium travels. As shown in FIG. 9, the cooling medium travels in the direction of the arrow 32. The cooling medium may be any medium used in refrigerator systems for removing heat to cool aspects of a refrigerator, such as a refrigerant or coolant. To form ice cubes, a water supply 58 fills the ice mold with water to a predetermined level. The intelligent control 60 works to sense when the ice molds are empty and when they have been filled by the water supply 58. The cooling loop 28, which is in contact with the ice mold 26, has a cooling medium pass through the conduit of the cooling loop 28 at the portion that is in contact with the ice mold 26. The cooling medium removes heat from the water in the ice mold to cool the water to a below freezing temperature. This leaves ice cubes in the mold, which can be ejected into the storage container 50. It should be noted that while the term "ice cubes" is used in this invention, it should be appreciated that the ice may be in shapes other than cubes, and the term "cubes" is a term generally used in the art to describe frozen water. A drain conduit 29 may be provided to drain water that is periodically defrosted off of the cooling loop 28 and air chamber 34.

Figure 5:
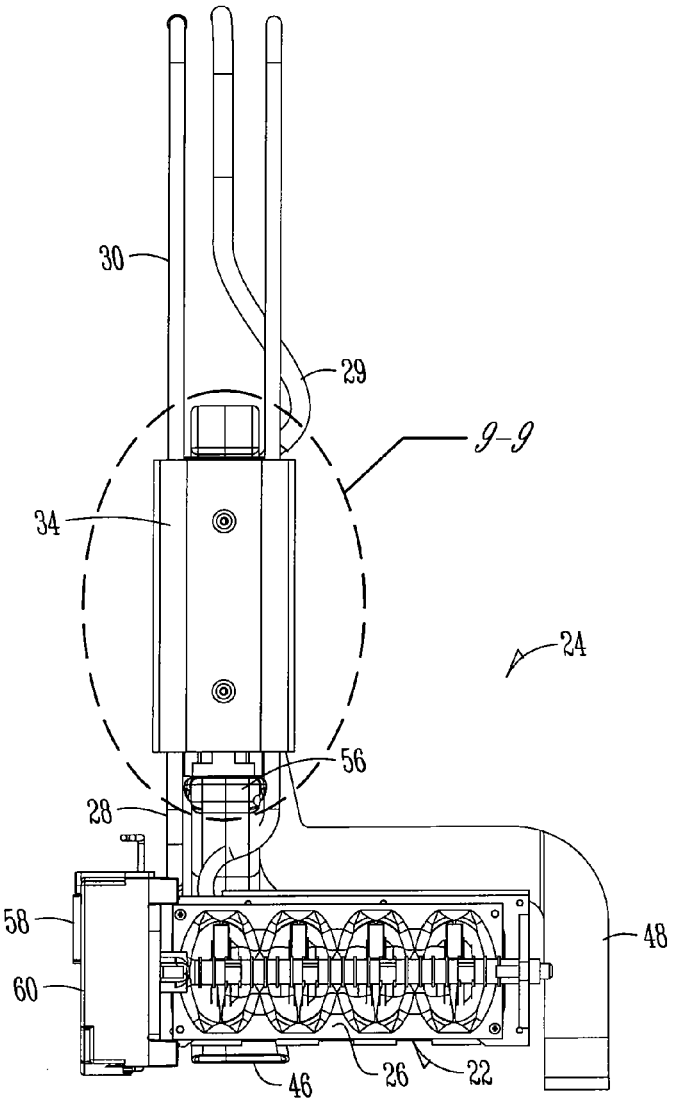
FIG. 5 is a top view of the ice making system of FIG. 3.
Figure 6:
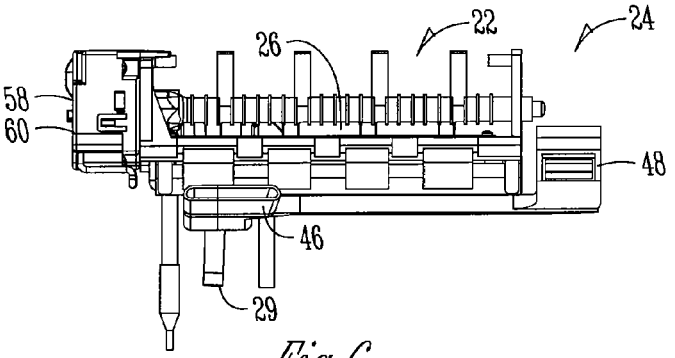
FIG. 6 is a front view of the ice making system of FIG. 3.
Figure 7:
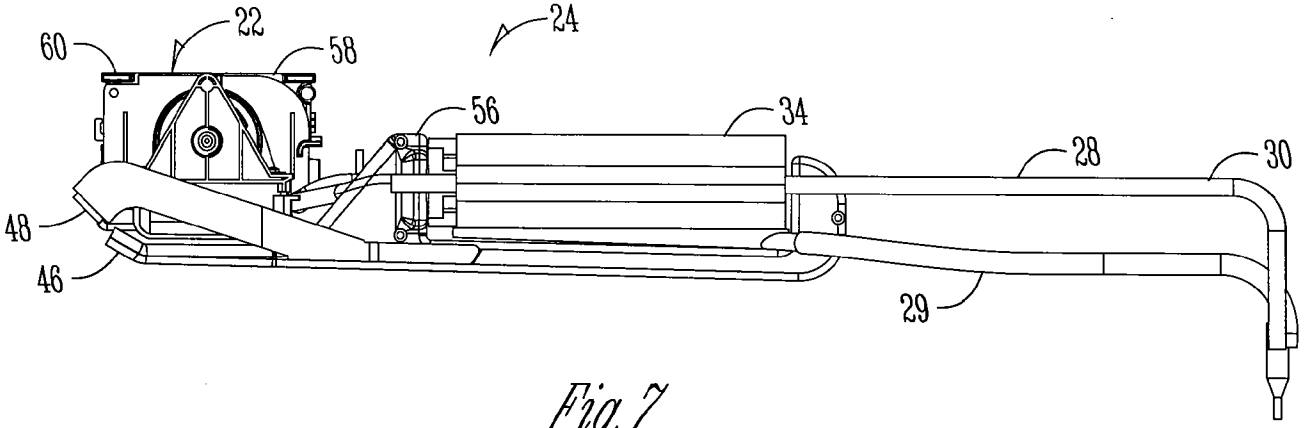
FIG. 7 is a side view of the ice making system of FIG. 3.
Figure 8:
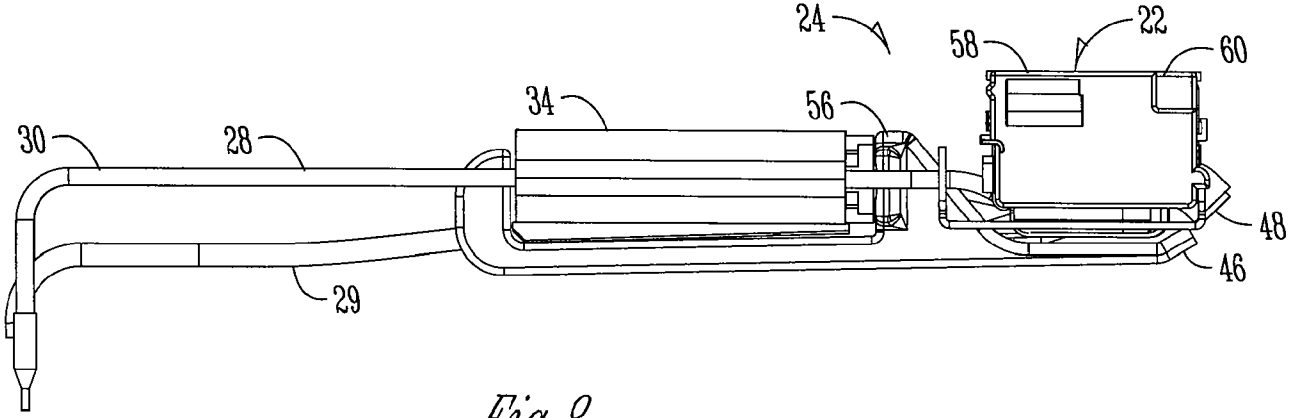
FIG. 8 is an opposite side view of the ice making system of FIG. 7.

Located away from the ice maker 22, but in contact with at least one portion of conduit of the cooling loop 28 in the ice making system 24, is an air flow chamber 34. The air flow chamber 34 is used to cool ambient air within the chamber to be passed over formed ice cubes 54 in the ice storage container 50 to prevent the cubes from melting within the container. FIGS. 5 and 9 show the air flow chamber 34 more clearly. The air flow chamber includes a first end 40 and a second end 42 opposite the first end. FIG. 9 shows the inside of the air flow chamber. The chamber includes a plurality of offset protrusions 36, which create a channel 38 on a portion of conduit 30 of the cooling loop 28. The channel 38 causes air being passed through the air flow chamber 34 to pass back and forth over a larger surface area of the conduit 30. The cooling medium, as shown by arrow 32, removes heat from the ambient air passing over the conduit to cool the air. Therefore, as shown in FIG. 9, once the air has reached the second end 42 of the channel, it will be cooled to a temperature low enough to keep ice cubes 54 in the ice storage container 50 from melting. It should also be noted that a second channel, shown by the arrow 44, may be included in the air flow chamber 34 to further increase the amount of air that can be cooled by the cooling loop 28 to be passed over the ice cubes 54 in the ice storage container 50. The second channel 44 will also include a plurality of offset protrusions, creating a back and forth path over a portion of conduit 30 that has cooling medium passing through it to cool the air.

Located adjacent the second end 42 of the air flow chamber is a fan and fan assembly 56. The fan and fan assembly includes fan blades and a motor, and is used to direct air through the air flow chamber 34 and into the ice storage container 50. Also included with the ice making system 24 is a supply duct 46, positioned adjacent the fan 56. The supply duct 46 begins at the fan and ends at a position adjacent an opening of the ice storage container 50. The supply duct 46 helps to direct cooled air 62 from the second end 42 of the air flow chamber 34 to within the ice storage container 50. Yet further, a return duct 48 is included within the ice making system 24. The return duct 48 generally extends from a second opening, separate from the supply duct 46, of the ice storage container and ends at the first end 40 of the air flow chamber 34. The return duct 48 is used to direct air that has been warmed within the ice storage container to the first end of the air flow chamber 34 to be re-cooled and redirected to the ice storage container 50, as will be discussed in greater detail below. It should also be noted that the intelligent control 60 of the ice making system 24 may be used to control operation of the fan 56, such that the fan is not running at all times. This will reduce the amount of energy required to operate the ice making system 24 of the refrigerator 10 of the present invention.

Figure 10:
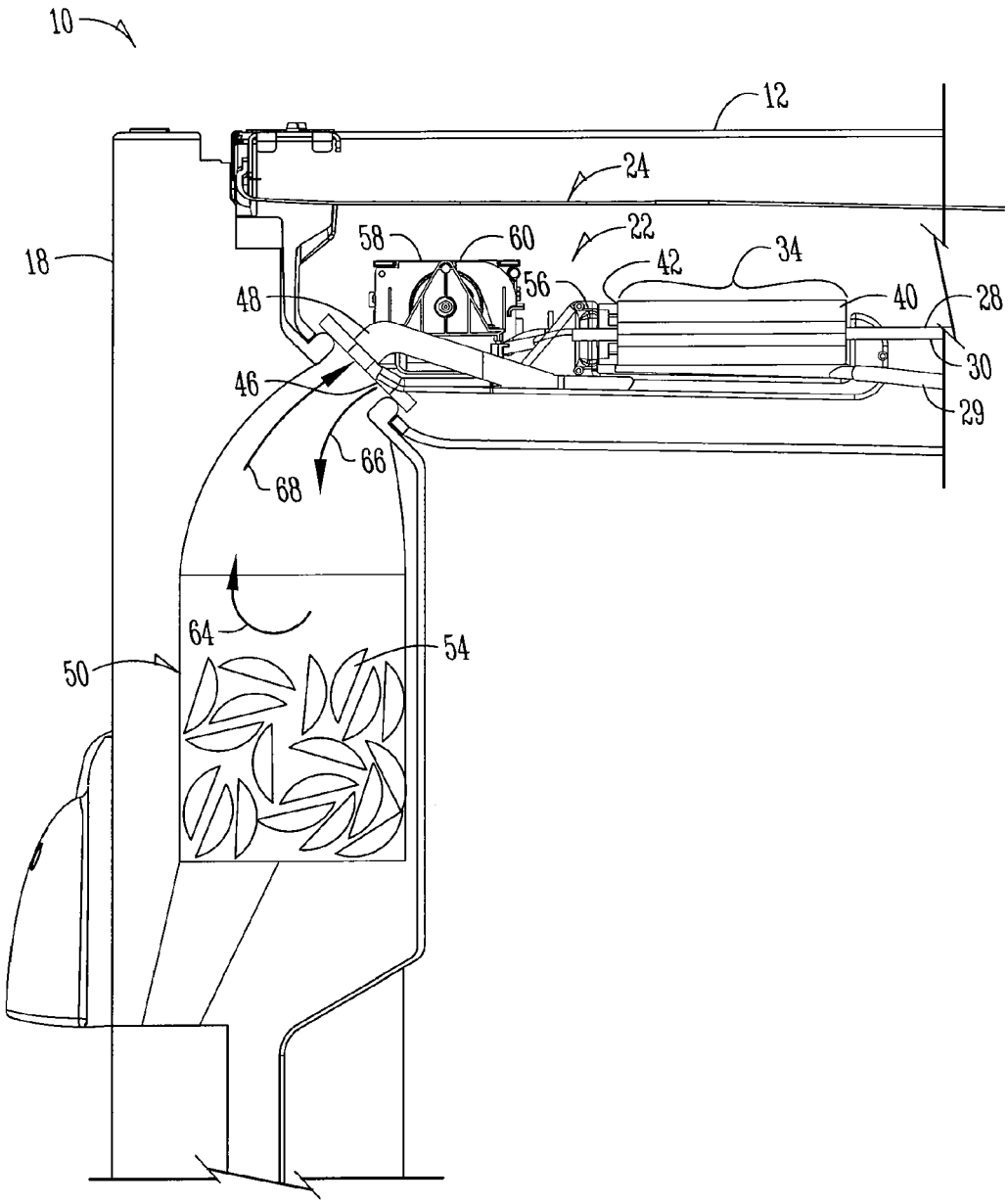
FIG. 10 is a view of the method of cooling the ice in the ice storage compartment according to an embodiment of the present invention.

FIG. 10 shows structure for performing a method of cooling ice in an ice storage container 50 according to the ice making system 24 of the present invention. The refrigerator 10 includes the ice making system 24 in the fresh food cabinet or housing 12 of the refrigerator 10. The ice making system 24 includes the direct contact ice maker 22 and rest of the system 24 as described with regard to FIGS. 3-9. Once water is added to the ice mold, frozen, and ejected into the ice storage container 50, air will need to be cooled and passed over the ice cubes 54 to prevent them from melting within the ice container. Therefore, the addition of air from the air flow chamber 34 may be used. Ambient air at the first end 40 of the air flow chamber 34 is directed through the first and/or second channel 38, 44, where the coolant passing through the conduit 30 of the cooling loop 28 removes heat from the air. By the time the air has reached the second end 42 of the air flow chamber 34, the air has been cooled to a temperature below freezing. The fan 56 and supply duct 46 then direct the cooled air 62 into the ice storage container 50, as shown by arrow 66 in FIG. 10. The cooled air is then passed over the ice cubes 54 where it removes heat from the area directly adjacent the ice cubes, which causes the air to warm.

This warmed air 64 is directed, as shown by arrow 68 in FIG. 10, by the return duct 48 to the first end 40 of the air flow chamber 34. This warmed air 64 is then passed through one or both of the channels of the air flow chamber to be re-cooled and recirculated through the ice storage container 50. Thus, a cycle of recirculated air can be used to keep the ice cubes 54 in the ice storage container 50 from melting. In addition, because the air is cooled by the cooling loop 28 already used by the ice making system 24, no additional energy is required to cool the air, keeping the process efficient and inexpensive.

The description and disclosures are merely exemplary in nature and, thus, contemplates numerous, variations, and alternatives. For example, variations in configuration of the refrigerator, variations in the type of ice making system, variations in the configuration of the air flow chamber, configurations in the manner of ice storage, variations in the fan and fan assembly, and other variations, options, and alternatives are within the spirit and scope of the invention.

What is claimed is:

1. A refrigerator, comprising:

a refrigerator cabinet;

a fresh food compartment disposed within the refrigerator cabinet;

at least one door providing access to the fresh food compartment;

a direct contact ice maker in the refrigerator cabinet for making ice comprising an ice mold and a water supply;

a cooling loop having a portion in contact with the ice mold, the cooling loop comprising a conduit for fluidly transporting a cooling medium;

an ice storage container adjacent to the ice maker; and an airflow chamber positioned on the cooling loop adjacent the ice maker along the same path of the cooling medium, the airflow chamber including a channel for air to pass through in contact with the cooling loop to cool the air via the cooling medium as the cooling medium travels towards the ice maker and before the cooling medium reaches the ice maker, and a fan assembly operably associated with the airflow chamber such that the fan assembly directs cooled air via a supply duct from the airflow chamber to the ice storage container; and a return duct extending from the ice storage container to a first end of the airflow chamber to return air from the ice storage container to the airflow chamber wherein the medium of the conduit of the cooling loop is used to cool the air in the airflow chamber and to contact the ice mold in a single pass through cooling loop;

wherein the cooling medium passes from at least a portion of the airflow chamber to the ice mold; and wherein the channel of the airflow chamber includes a plurality of offset protrusions to pass the air over a larger surface area of the cooling loop to remove heat from the air.

2. The refrigerator of claim 1 further comprising the return duct operatively connected to the ice storage container for returning air from the ice storage container to the airflow chamber.

3. The refrigerator of claim 1 wherein the channel of the airflow chamber includes the plurality of offset protrusions.

4. The refrigerator of claim 1 wherein the airflow chamber includes a second end opposite from the first end, and wherein the fan assembly is attached at the second end of the airflow chamber.

5. The refrigerator of claim 4 further comprising the supply duct connected to the fan assembly configured to direct air from the airflow chamber to the ice storage container.

6. The refrigerator of claim 1 wherein the ice storage container includes a removable ice bucket.

7. The refrigerator of claim 1 wherein the cooling medium is a refrigerant.

8. The refrigerator of claim 1 wherein the airflow chamber further comprises a second channel with offset protrusions in contact with a separate portion of the cooling loop beyond the portion of the cooling loop in direct contact with the ice mold.

9. A direct contact ice making system, comprising:

a direct contact ice maker including an ice mold and a water supply operably connected to the ice mold;

an ice storage compartment adjacent the ice mold;

a cooling loop having a portion in direct contact with the ice mold, the cooling loop comprising a conduit and a cooling medium transporting through the conduit;

an airflow chamber positioned on a portion of the cooling loop adjacent to the ice mold along the same path of the cooling medium, the airflow chamber including an air channel for cooling ambient air passing through the channel via the cooling medium as the cooling medium travels towards the ice maker and before the cooling medium reaches the ice maker;

a fan operably connected to the airflow chamber; and wherein the medium of the conduit of the cooling loop is used to cool the air in the airflow chamber and to contact the ice mold in a single pass through cooling loop;

wherein the cooling medium passes from at least a portion of the airflow chamber to the ice mold; and wherein the channel of the airflow chamber includes a plurality of offset protrusions to pass the air over a larger surface area of the cooling loop to remove heat from the air.

10. The system of claim 9 wherein the ice storage compartment includes a removable ice bucket contained within the ice storage compartment.

11. The system of claim 9 further comprising a supply duct attached to the fan and extending to the ice storage compartment.

12. The system of claim 11, wherein the airflow chamber includes a first end and a second end opposite the first end, and further comprising a return duct attached to the first end of the airflow chamber and extending to the ice storage compartment.

13. The system of claim 12 wherein the fan is connected at the second end of the airflow chamber.

14. The system of claim 9 further comprising an intelligent control operably connected to the fan to control operation of the fan.

15. The system of claim 9 wherein the channel of the airflow chamber further includes a plurality of offset protrusions.

16. A method of providing cold air circulation for an ice storage compartment in conjunction with a direct contact ice making system, comprising:

providing a refrigerator including said direct contact ice making system comprising an ice mold, a cooling loop having a portion in direct contact with the ice mold, an airflow chamber positioned on a portion of the cooling loop adjacent to the ice mold along the same path of the cooling loop, and a fan operably connected to the airflow chamber, and said ice storage compartment adjacent the ice making system;

cooling ambient air within the airflow chamber adjacent the portion of cooling loop;

directing the cooled air with the fan from the airflow chamber to the ice storage compartment; and directing warmed air from the ice storage compartment to the airflow chamber, wherein the warm air is re-cooled and redirected to the ice storage compartment; and wherein a medium of a conduit of the cooling loop is used to cool the air in the airflow chamber and to contact the ice mold in a single pass through the cooling loop with said air being cooled via the cooling medium as the cooling medium travels towards the ice maker and before the cooling medium reaches the ice maker.

17. The method of claim 16 wherein the ice making system further includes a supply duct positioned between the airflow chamber and the ice storage compartment.

18. The method of claim 17 wherein the ice making system further includes a return duct including a first end at the ice storage compartment and a second end connected to the airflow chamber.

19. The method of claim 18 wherein cooled air is directed through the supply duct to the ice storage compartment and warm air is directed through the first end of the return duct to the airflow chamber to be re-cooled.

* * * * *